United States Patent [19]

Dederich et al.

[11] Patent Number: 4,539,556

[45] Date of Patent: Sep. 3, 1985

[54] COMBUSTION PRODUCTS DETECTOR WITH ACCELERATED TEST

[75] Inventors: Stanley S. Dederich, Naperville; George A. Schoenfelder, Downers Grove; William M. Koster, Bartlett, all of Ill.

[73] Assignee: Pittway Corporation, Aurora, Ill.

[21] Appl. No.: 485,234

[22] Filed: Apr. 15, 1983

[51] Int. Cl.[3] ..... G08B 29/00; G08B 17/10

[52] U.S. Cl. ..... 340/515; 250/574; 340/630; 356/338

[58] Field of Search ..... 340/630, 629, 514, 515, 340/516; 250/573, 574, 575, 381, 384; 356/338

[56] References Cited

U.S. PATENT DOCUMENTS

| | | | |
|---|---|---|---|
| 3,234,536 | 2/1966 | Grant, Jr. et al. | 340/515 X |
| 3,543,260 | 11/1970 | Engh | 340/515 X |
| 3,585,621 | 6/1971 | Di Cello | 340/515 |
| 3,882,477 | 5/1975 | Mueller | 340/515 X |
| 3,930,246 | 12/1975 | Campbell | 340/516 X |
| 4,053,785 | 10/1977 | Lee et al. | 340/515 X |
| 4,065,759 | 12/1977 | Handing | 340/630 X |
| 4,068,130 | 1/1978 | Malinowski | 250/574 |
| 4,099,178 | 7/1978 | Ranney et al. | 340/515 |
| 4,125,779 | 11/1978 | Malinowski | 340/630 |
| 4,144,458 | 3/1979 | Doherty | 340/515 X |
| 4,144,459 | 3/1979 | Malinowski | 340/515 X |
| 4,163,969 | 8/1979 | Enemark | 340/630 |
| 4,196,426 | 4/1980 | Ogawa | 340/629 |
| 4,232,307 | 11/1980 | Marsocci | 340/515 |
| 4,321,466 | 3/1982 | Mallory et al. | 340/630 X |

OTHER PUBLICATIONS

Motorola Semiconductor Products Inc., specification sheet for circuit MC14463 and attached status report dated 5/12/81.

Motorola Semiconductor Products Inc., specification brochure for circuits MC14464 and MC14465 (4 pages) 5/12/81.

Texas Instruments Inc., specification brochure for AC5701N Dual-Transducer/Multiple-Sound Smoke Detector Integrated Circuit (13 pages) 4/5/79.

Cherry Semiconductor Corporation, specification brochure for CS-179 and CS-199 Smoke Detector Integrated Circuit with attached sheet entitled, "CS-179 Demonstration Board" (6 pages) 3-23-79.

Supertex Inc., specification brochure for SD-2 CMOS Photo-Electric Smoke Detector Integrated Circuit (7 pages) Jan. 1980.

*Primary Examiner*—James L. Rowland
*Assistant Examiner*—Daniel Myer
*Attorney, Agent, or Firm*—Emrich & Dithmar

[57] ABSTRACT

A battery-powered photoelectric smoke detector periodically samples the air in a smoke chamber. A manually-operated test button is provided for simulating smoke to test the device. The sampling frequency is determined by a first resistance. A frequency changing circuit includes a test switch, the movable contact of which is coupled to the test button and is responsive to operation thereof for connecting it parallel with the first resistance the series combination of a diode and a second resistance for increasing the sampling frequency. Means are provided for back-biasing the diode to disable the frequency changing circuit when the detector detects smoke.

20 Claims, 4 Drawing Figures

COMBUSTION PRODUCTS DETECTOR WITH ACCELERATED TEST

BACKGROUND OF THE INVENTION

The present invention relates to combustion products detectors and, in particular, to combustion products detectors of the battery-powered photoelectric type. The invention relates specifically to the apparatus for testing a combustion products detector.

In order to minimize the current drain on the batteries of a battery-powered photoelectric smoke detector, the device is rendered operative to look for the presence of smoke by sampling the ambient air relatively infrequently, typically on the order of once every ten to thirty seconds. Thus, a control means is provided for periodically actuating the photoelectric sensing means for emitting a flash of light into a smoke chamber to see if any light-reflecting smoke is present. In order to test the operation of the device, it is typically provided with a manually-operated test button. The test button is connected to a reflective member which is movable into the smoke chamber for optical coupling with the photoelectric sensing means. Thus, when the reflector is inserted during test, it's reflective characteristics simulate the presence of smoke and, if the device is operating properly, the alarm signal will be sounded.

However, because the photoelectric sensing means is actuated only infrequently, the user may have to hold the test button in for as long as thirty seconds to keep the reflector in the smoke chamber until the photoelectric sensing means is actuated. This is a considerable inconvenience, particularly in view of the fact that smoke detectors are commonly located on ceilings or other relatively difficult-to-reach locations. Furthermore, because of the relatively long time that he may have to wait in order to properly perform the test function, the user may mistakenly conclude before the end of this time that the device is malfunctioning.

Photoelectric combustion products detectors commonly have a feature whereby the device must detect smoke on two or more consecutive samplings before the alarm is sounded, in order to minimize the chance of spurious or false alarms. Thus, it is known in such devices to increase the sampling rate in response to the first smoke detection, so that the subsequent smoke detections will occur more rapidly. But this does not solve the time delay problem during test, since it does not eliminate the delay before the first detection of simulated smoke.

SUMMARY OF THE INVENTION

It is a general object of the present invention to provide an improved battery-powered photoelectric combustion products detector which avoids the disadvantages of prior detectors while affording additional structural and operating advantages.

It is an important object of this invention to provide a combustion products detector of the type set forth which reduces the time for the first "smoke" detection during test of the device.

In connection with the foregoing object, it is another object of this invention to provide a combustion products detector of the type set forth, wherein the smoke sampling frequency is increased in response to operation of the test mechanism.

Still another object of this invention is the provision of a combustion products detector of the type set forth, wherein the acceleration of the sampling frequency occurs substantially simultaneously with the operation of the test mechanism.

It is another object of this invention to provide a combustion products detector of the type set forth, wherein the test mode sampling acceleration means is disabled once "smoke" is detected.

These and other objects of the invention are attained by providing a combustion products detector including combustion products sensing means, alarm means responsive to the sensing of combustion products by the sensing means, control means for periodically enabling the sensing means and test means selectively operable for simulating the presence of combustion products, the improvement comprising: frequency change means coupled to the control means and responsive to operation of the test means for changing the frequency of enablement of the sensing means.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
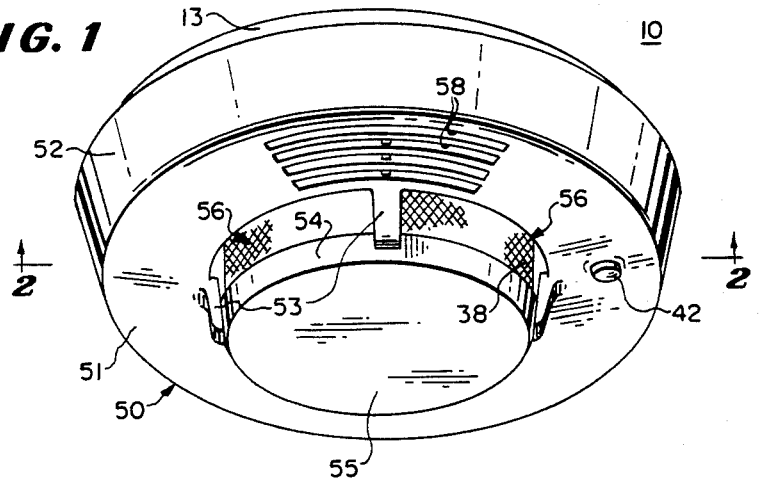
FIG. 1 is a perspective view of a combustion products detector constructed in accordance with and embodying the features of the present invention.
Figure 2:
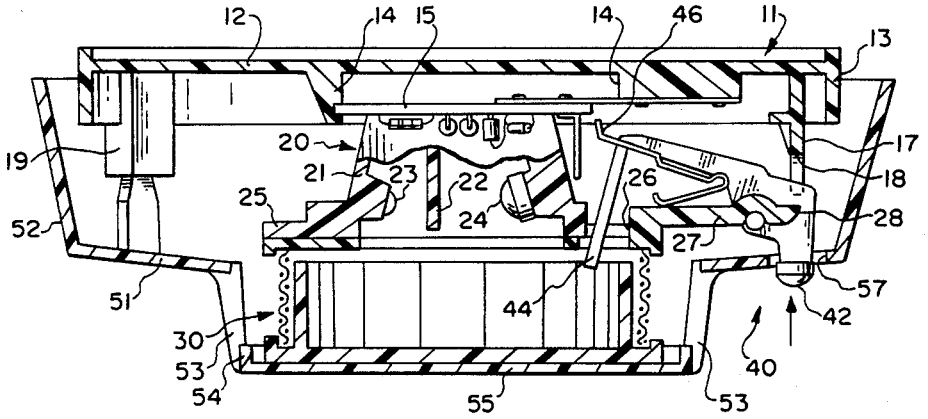
FIG. 2 is an enlarged view in vertical section taken generally along the line 2—2 in FIG. 1, and illustrating the test assembly in its normal rest position.
Figure 3:
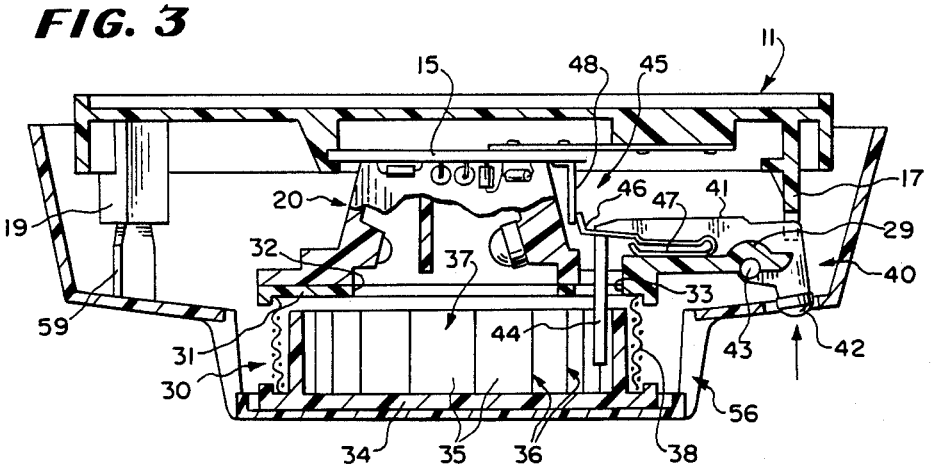
FIG. 3 is a view similar to FIG. 2 illustrating the test assembly in its test position.

Referring now to FIGS. 1–3 of the drawings, there is illustrated a combustion products detector, generally designated by the numeral 10, constructed in accordance with and embodying the features of the present invention. The combustion products detector 10 is a battery-powered, photoelectric detector which includes a base 11 adapted to be mounted on a ceiling or other suitable support surface. The base 11 has a substantially circular wall 12, integral around the perimeter thereof with a depending cylindrical peripheral wall 13. Integral with the circular wall 12 and depending therefrom are a plurality of mounting projections 14 adapted for supporting a printed circuit board 15. Also integral with the circular wall 12 and depending therefrom is an elongated mounting arm 17 for a purpose to be described more fully below, the arm 17 being provided with a slot 18 in its distal end. A plurality of of hollow attachment posts 19 (one shown) are integral with the circular wall 12 at equiangularly spaced apart points thereon and depend therefrom, each of the posts 19 having an opening in the distal end thereof.

Mounted on the circuit board 15 and depending therefrom is an optical assembly, generally designated by the numeral 20 which includes a hollow, open-bottom housing 21 defining a chamber therein, and provided with a septum 22 dividing the chamber into two separate compartments. Mounted on the housing 21, respectively in the two compartments, are an infrared LED 23 and a photodiode 24, both being directed generally toward the septum 22, the dimensions of the septum 22 being such as to prevent light from the LED 23 from impinging directly on the photodiode 24. The housing 21 is provided around the lower end thereof with a laterally outwardly extending attachment flange 25, provided at one end thereof with an aperture 26 therethrough. The attachment flange 25 includes an elongated extension 27 which extends substantially parallel to the circular wall 12 and is provided with a clevis end 28 having a slot (not shown) formed therein. Formed in the extension 27 adjacent to the clevis end 28 is an arcuate bearing seat 29.

Secured to the attachment flange 25 is a smoke chamber assembly, generally designated by the numeral 30, which includes a substantially circular inner wall 31 having a circular central aperture 32 disposed substantially in registry with the open bottom of the housing 21, and also having a peripheral aperture 33 which is disposed in registry with the aperture 26 in the attachment flange 25. The smoke chamber assembly 30 also includes a circular outer wall 34 disposed beneath and substantially parallel to the inner wall 31 and connected thereto by suitable connecting means (not shown). Integral with the inner surface of the outer wall 34 and projecting upwardly therefrom are a plurality of spaced-apart, part-cylindrical louver plates 35 which are arranged in overlapping relationship for defining a louvered, generally cylindrical wall, which cooperates with the inner and outer walls 31 and 34 for defining a smoke chamber 37, the spaces between the louver plates 35 defining openings 36 for providing access to the smoke chamber 37.

The smoke chamber assembly 30 is formed of substantially non-reflective material, the louver plates 35 being so constructed and arranged as to substantially prevent the admission of ambient light into the smoke chamber 37, while permitting the flow of combustion products thereinto through the openings 36. A cylindrical screen 38 encircles the louver plates 35 and is trapped between the inner and outer walls 31 and 34 for screening out large particles of combustion products and for cooperating with the louver plates 35 for limiting light into the smoke chamber 37.

In operation, because there is no direct optical path between the LED 23 and the photodiode 24, and because the smoke chamber assembly 30 is non-reflective, light from the LED 23 cannot normally reach the photodiode 24. However, when smoke or other combustion products are present in the smoke chamber 37, the light from the LED 23 reflects off the particles of smoke or other combustion products, this reflected light reaching the photodiode 24 to activate it and to give an indication of smoke detection, all in a well known manner.

The combustion products detector 10 also includes a test assembly, generally designated by the numeral 40 which includes a lever 41 disposed in the slot in the clevis end 28 of the extension 27 and provided at one end thereof with a push button 42. Projecting laterally from the lever 41 intermediate its ends is a pivot pin 43 which is rotatably supported in the arcuate bearing seat 29 for pivotal movement of the lever 41 about the axis of the pivot pin 43. Integral with the lever 41 at its other end and depending therefrom is a substantially rectangular reflector vane 44 of light-reflective material, the reflector vane 44 having the distal end thereof disposed for insertion through the apertures 26 and 33 into the smoke chamber 37.

The test assembly 40 includes a test switch generally designated by the numeral 45, which includes a movable spring contact 46 which is mounted on the lever 41 and projects outwardly beyond the reflector vane 44, the spring contact 46 having a folded leaf portion 47 which bears against the extension 27 of the housing attachment flange 25, resiliently to hold the pivot pin 43 firmly seated in the arcuate bearing seat 29, and resiliently urging the lever 41 toward rotation in a clockwise direction, as viewed in the drawings, to a normal rest position illustrated in FIG. 2, wherein the reflector vane 44 is withdrawn from the smoke chamber 37. The test switch 45 also includes a fixed contact 48 which is fixedly secured to the circuit board 15 and is spaced from the movable contact 46 when the lever 41 is in its normal rest position.

By manually pushing the button 42 upwardly in the direction of the arrow in FIGS. 2 and 3, the lever 41 is pivoted about the axis of the pivot pin 43 in a counterclockwise direction, against the urging of the spring leaf 47, to a test position, illustrated in FIG. 3, wherein the movable contact 46 engages the fixed contact 48 for closing the test switch 45, and wherein the reflector vane 44 is inserted into the smoke chamber 37 in a position for reflecting light from the LED 23 to the photodiode 24. This movement of the lever 41 to its test position is accommodated by the slot 18 in the mounting arm 17.

The combustion products detector 10 also includes a cover 50 which has an annular wall 51 integral around the outer perimeter thereof with an upstanding frustoconical skirt 52, and integral around the inner edge thereof with a plurality of equiangularly spaced apart, depending webs 53. The lower ends of the webs 53 are, in turn, integral with a cylindrical flange 54 of a circular end wall 55, the webs 53 cooperating with the end wall 55 and with the annular wall 51 for defining a plurality of large, generally rectangular openings 56 for allowing the flow of air to and from the smoke chamber assembly 30. The annular wall 51 has a circular aperture 57 therethrough for accommodating the button 42 of the test lever 41, and is also provided with a plurality of arcuate slots 58.

Integral with the annular wall 51 at equiangularly spaced apart points therealong and projecting upwardly therefrom are a plurality of attachment fingers 59 respectively disposed for insertion in the open ends of the attachment posts 19 for mounting the cover 50 on the base 11. More particularly, the attachment posts 19 may include latch means (not shown) for holding the cover 50 in place in its mounted position illustrated in FIGS. 2 and 3, in which position the skirt 52 overlaps the peripheral wall 13 of the base 11 for cooperation therewith to conceal the internal mechanism of the combustion products detector 10. As illustrated in FIG. 2, when the cover 50 is disposed in its mounted position, the test button 42 projects through the aperture 57 and extends a predetermined distance beneath the annular wall 51 for access by a user.

Figure 4:
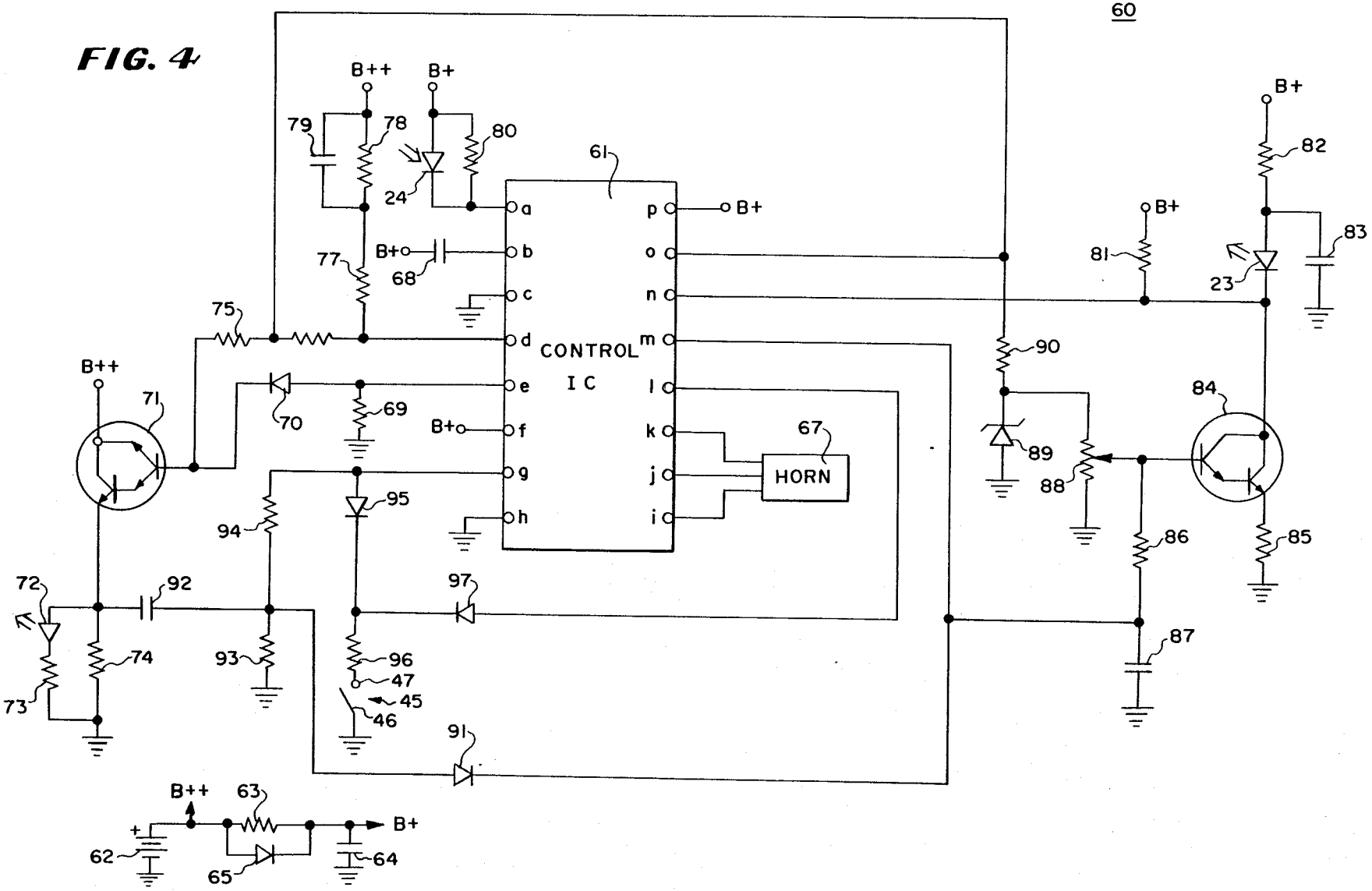
FIG. 4 is an electrical schematic circuit diagram of the control circuitry for the combustion products detector of FIG. 1.

Referring now to FIG. 4 of the drawings, there is illustrated an electrical circuit, generally designated by the numeral 60, for controlling the operation of the combustion products detector 10, it being appreciated that the components of the electrical circuit 60 are mounted on the circuit board 15. The circuit 60 includes an integrated control circuit (IC) 61 having a plurality of terminal pins a–p. The IC 61 may be a CMOS IC of the type sold by Supertex Inc. of Sunnyvale, Calif. under the designation SD-2. Power for the circuit 60 is provided by a battery 62, the positive terminal of which is designated B++, and is preferably at +9 volts. Connected in series across the battery 62 are a resistor 63 and a capacitor 64, a diode 65 being connected in parallel with the resistor 63. A B+ supply is provided at the junction of the resistor 63 and the capacitor 64. The pins i, j and k of the IC 61 are connected to an alarm horn 67, which is preferably a piezoelectric horn of standard construction. Pin b of IC 61 is connected through a capacitor 68 to the B+ supply. Pins f and p are connected directly to the B+ supply while pins c and h are connected to ground.

Pin e of the IC 61 is connected through a resistor 69 to ground and through a diode 70 to the base of a Darlington transistor 71, the collector of which is connected to the B++ supply. The emitter of the transistor 71 is connected in series through a visible-light LED 72 and a current-limiting resistor 73 to ground, a resistor 74 being connected in parallel with the LED 72 and the resistor 73. The base of the transistor 71 is also connected through series resistors 75 and 76 to pin d of the IC 61. Pin d is also connected through series resistors 77 and 78 to the B++ supply, a capacitor 79 being connected in parallel with the resistor 78. Pin a of the IC 61 is connected to the cathode of the photodiode 24, the anode of which is connected to the B+ supply, a resistor 80 being connected in parallel with the photodiode 24.

Pin n of the IC 61 is connected through a resistor 81 to the B+ supply, and is also connected to the cathode of the infrared LED 23. The anode of the LED 23 is connected through a current-limiting resistor 82 to the B+ supply, and through a capacitor 83 to ground. Pin n of the IC 61 is also connected to the collector of a Darlington transistor 84, the emitter of which is connected through a current-limiting resistor 85 to ground. A resistor 86 and a capacitor 87 are connected in series between the base of the transistor 84 and ground. The base of the transistor 84 is also connected to the wiper of a potentiometer 88, which is connected in series with a resistor 90 between pin o of the IC 61 and ground. A Zener diode 89 is connected in parallel with the potentiometer 88. Pin o of the IC 61 is also connected to the junction between the resistors 75 and 76, while pin m is connected to the junction between the resistor 86 and the capacitor 87.

Pin m of the IC 61 is also connected to the cathode of a diode 91, the anode of which is connected through a capacitor 92 to the emitter of the transistor 71, and through a resistor 93 to ground. The anode of the diode 91 is also connected through a resistor 94 to pin g of the IC 61. Connected in series between the pin g and ground are a diode 95, a resistor 96 and the normally-open test switch 45. The cathode of the diode 95 is connected to the cathode of a diode 97, the anode of which is connected to pin 1 of the IC 61.

In operation, the IC 61 has an internal oscillator, the frequency of which is controlled by the resistors 93 and 94. The IC 61 also includes a ripple counter which divides the clock frequency, different points in the counter being picked off for different timing outputs. In normal operation, the IC 61 produces an "enable" output on pin e about once every 12 seconds, the enable output being in the form of a pulse of about 3 ms duration. This "enable" output is applied through the diode 70 to the base of the Darlington transistor 71 for turning it on to energize the LED 72, thereby giving a visible indication that the timing circuit is operating.

At the end of each "enable" pulse, a one-shot multivibrator in the IC 61 produces about a 150-microsecond sampling pulse which appears at pin o, causing it to become high for 150 microseconds, the duration of this sampling pulse being controlled by the resistor 69 connected to pin e. This high output at pin o is coupled through the resistor 90 and the potentiometer 88 to the base of the Darlington transistor 84 for turning it on. Thus, the transistor 84 draws current through the LED 23 for 150 microseconds. More specifically, the capacitor 83 is charged during the 12-second interval between sampling pulses, and when the transistor 84 is turned on, the capacitor 83 discharges through the LED 23, the values of the various components being such that the capacitor 83 provides about 100 to 300 ma to drive the LED 23. The IC 61 is configured so that it can be placed into any of several different test modes during factory setup. The resistor 81 serves to maintain pin n at approximately B+ so that it cannot go into one of these factory test modes after the combustion products detector 10 is installed in the field.

The infrared flash from the LED 23 is coupled into the smoke chamber 37 and, in the presence of smoke, will cause a reflection to energize the photodiode 24 for applying an input signal to pin a of the IC 61. The capacitor 68 serves as a memory capacitor for monitoring the electrical noise in the circuit. This effectively sets up a reference in the IC 61 against which the photodiode 24 works, so that the output signal from the photodiode 24 must exceed this reference in order for the IC 61 to register a sensing of smoke.

The circuitry connected to pin d of the IC 61 is to sense battery trouble. If the battery 62 is low or is bad (has a high resistance), this condition is reported at pin d. Resistors 76–78 set up a voltage divider input for the battery trouble circuit. Because of the high impedance of a bad battery, when the circuit attempts draw a lot of current from it, the voltage at the battery terminals drops. Thus, when the visible LED 72 is turned on for 3 ms during the "enable" pulse, it draws current from the battery 62 and, if the battery 62 has a high impedance it will produce a voltage drop that is coupled to pin d of the IC 61.

When the IC 61 receives an input at its pin a from the photodiode 24, indicative of a sensing of smoke, internal circuitry in the IC 61 causes the sampling rate to speed up, so that "enable" pulses at the pin e and sampling pulses at the pin n are produced about once every 1.5 seconds. The circuitry of the IC 61 is such that it must see two consecutive inputs at pin a before the system will go into alarm, to reduce the chance of false alarms. When two consecutive inputs at pin a have been received, indicating two successive smoke detections, pin m becomes high and the horn 67 is turned on through pins i, j and k. The high at pin m causes some current to be fed back through the resistor 86 to the base of transistor 84. This provides a little more current for the LED 23, making the unit become more sensitive.

The horn 67 has a mechanical resonance which is fed back into pins i and j and tends to desense the IC 61. In order to alleviate this problem, the diode 91, the capacitor 92 and the resistor 93 are provided. Thus, when the system goes into alarm, the high at pin m back-biases the diode 91, causing the junction between the capacitor 92 and the resistor 93 to become high for a short time to turn off the clock of IC 61 at pin g, which prevents anything from happening in the IC 61. The IC 61 is held off for about 20 or 25 ms until all of the mechanical resonance of the horn 67 has dissipated, after which the IC 61 returns to normal operation.

Pin 13 is adapted to be connected to other detectors when the detector 10 is part of a system of such detectors. This connection causes the detector 10 to go into alarm when any other detector in the system goes into alarm. When the horn 67 (or the horn of another detector in the system) is energized, it causes noise to be generated on the B+ line, impairing the sensitivity of the IC 61 and making it difficult to detect the input signal at pin a, which is typically in the range of 1 mv. Accordingly, the circuitry of the IC 61 operates to momentarily turn the horn 67 off just before each sampling pulse. The B+ connected to pin f causes the horn 67 to be modulated by internal circuitry of the IC 61 to have a duty cycle of about 80%. If pin f were at ground, the horn 67 would operate continuously.

The test operation of the combustion products detector 10 will now be explained with reference to the circuit 60. When it is desired to test the operation of the combustion products detector 10, the button 42 is manually depressed, thereby moving the reflector vane 44 to its test position inserted in the smoke chamber 37 and, simultaneously, closing the test switch 45. In the absence of the test switch 45, the user might have to wait up to 12 seconds in the preferred embodiment (or as long as 30 seconds, depending upon the predetermined normal sampling rate of the IC 61), until the next sampling pulse is emitted at the pin n to energize the LED 23. But closure of the test switch 45 connects the resistor 96 in parallel with the resistors 93 and 94, through the diode 95. This reduces the resistance seen at the pin g, thereby increasing the clock frequency so that sampling pulses are produced at the pin o about once every 2 seconds.

Thus, after the button 42 has been held in for only about 2 seconds, the first sampling pulse occurs. When this sampling pulse occurs, the LED 23 is energized, producing a 150-microsecond light flash which is reflected from the reflector vane 44 to energize the LED 23, producing a smoke sense input at pin a of IC 61. The input at pin a causes the sampling rate to increase by operation of the internal circuitry of the IC 61 to produce sampling pulses about once every 1.5 seconds, as described above. But this assumes that the clock is operating at its normal frequency. In order to return it to its normal frequency, the test circuitry which comprises the diode 95, the resistor 96 and the switch 45 is disabled once a smoke sense input is received at pin a. To accomplish this, the pin 1 is coupled to the cathode of the diode 95. Whenever there is a smoke sense input at pin a, the pin 1 becomes high and stays high until there is an absence of smoke sense input at pin a for two consecutive sampling times. This high at pin 1 back-biases the diode 95, rendering it nonconductive and thereby eliminating the current path to ground in parallel with the resistors 93 and 94, so that those resistors then resume control of the internal IC 61 clock, returning it to normal operation. During this normal operation, the pin g becomes alternately high and low. The diode 97 is necessary to prevent a high at the pin g from being fed back to the pin 1.

In summary it can be seen that once the test button 42 is pushed, it need be held depressed for no more than 4 seconds in order to actuate the horn 67, i.e., about 2 seconds for the first smoke sense input to appear at pin a, and about 1.5 seconds for the second smoke sense input to appear at pin a for activating the horn 67. It will be appreciated, that by selection of the values of the various components of the circuit 60, the timing of the IC 61, during both normal operation and during test, can be changed.

From the foregoing, it can be seen that there has been provided an improved combustion products detector of the battery-powered photoelectric type, which has a speeded up alarm test operation, so as to minimize the amount of time that the test button need be held depressed to activate the alarm.

We claim:

1. In a combustion products detector including combustion products sensing means, alarm means responsive to the sensing of combustion products by the sensing means, control means for periodically enabling the sensing means and test means selectively operable for simulating the presence of combustion products, the improvement comprising: frequency change means coupled to the control means and responsive to operation of the test means for changing the frequency of enablement of the sensing means.

2. The combustion products detector of claim 1, wherein said frequency change means operates substantially simultaneously with the operation of the test means.

3. The combustion products detector of claim 1, and further including means for manually operating the test means.

4. The combustion products detector of claim 3, and further including means mechanically coupling said frequency change means to the test means.

5. The combustion products detector of claim 1, wherein said frequency change means increases the frequency of enablement of the sensing means.

6. The combustion products detector of claim 1, wherein the sensing means is photoelectric.

7. The combustion products detector of claim 6, wherein the test means includes reflective means movable between a normal position optically isolated from the sensing means and a test position optically coupled to the sensing means.

8. The combustion products detector of claim 1, wherein the control means includes impedance means for determining the frequency of enablement of the sensing means, said frequency change means including means for changing the impedance of said impedance means.

9. The combustion products detector of claim 8, wherein said frequency change means includes an impedance element and switch means operable in response to operation of the test means for connecting said impedance element to said impedance means.

10. In a combustion products detector including combustion products sensing means, alarm means responsive to the sensing of combustion products by the sensing means, control means for periodically enabling the sensing means at a low first frequency during standby and at a higher second frequency in response to sensing of combustion products by the sensing means, and test means selectively operable for simulating the presence of combustion products, the improvement comprising: frequency change means coupled to the control means and responsive to operation of the test means for changing the frequency of enablement of the sensing means to a third frequency, and means coupled to the control means and to said frequency change means for disabling said frequency change means in response to the sensing of combustion products by the sensing means.

11. The combustion products detector of claim 10, wherein said third frequency is between said first and second frequencies.

12. The combustion products detector of claim 10, wherein the control means includes first impedance means for determining the first frequency of enablement of the sensing means, said frequency change means including second impedance means and switch means for connecting said second impedance means in parallel with said first impedance means in response to operation of the test means.

13. The combustion products detector of claim 12, wherein said second impedance means includes a unidirectional current flow device, said disabling means being operative to render said unidirectional current flow device non-conductive in response to sensing of combustion products by the sensing means.

14. The combustion products detector of claim 13, wherein said disabling means include means for preventing current flow from said frequency change means to the control means.

15. In a combustion products detector including combustion products sensing means, alarm means responsive to the sensing of combustion products by the sensing means, control means for periodically enabling the sensing means and test means selectively movable between a normal condition and a test condition for simulating the presence of combustion products, the improvement comprising: first impedance means coupled to the control means so that the frequency of enablement of the sensing means is a function of the impedance of said first impedance means, second impedance means, and switch means coupled to said first and second impedance means and to the test means and responsive to movement of the test means to its test condition for connecting said first and second impedance means in parallel.

16. The combustion products detector of claim 15, wherein each of said first and second impedance means includes a resistor.

17. The combustion products detector of claim 15, wherein said second impedance means includes a unidirectional current flow device, and further including means coupled to the control means and to said second impedance means for rendering said unidirectional current flow device non-conductive in response to sensing of combustion products by the sensing means.

18. The combustion products detector of claim 15, wherein the sensing means is photoelectric, the test means including reflector means movable between a normal position isolated from the sensing means and a test position optically coupled to the sensing means.

19. The combustion products detector of claim 18, wherein said switch means includes a movable contact mechanically coupled to said reflector means for movement simultaneous therewith to close said switch means when said reflector means is moved to its test position.

20. The combustion products detector of claim 19, and further including bias means resiliently urging said reflector means to the normal position thereof, and means for effecting manual movement of said reflector means to the test position thereof.

* * * * *